US007832414B1

(12) United States Patent
Giannuzzi

(10) Patent No.: US 7,832,414 B1
(45) Date of Patent: Nov. 16, 2010

(54) HAIRSTYLING METHOD

(76) Inventor: Gino Giannuzzi, 1595 Taylor Ave., Westbury, NY (US) 11590

( * ) Notice: Subject to any disclaimer, the term of this patent is extended or adjusted under 35 U.S.C. 154(b) by 550 days.

(21) Appl. No.: 11/906,502

(22) Filed: Oct. 3, 2007

(51) Int. Cl.
*A45D 7/00* (2006.01)

(52) U.S. Cl. ..... 132/200

(58) Field of Classification Search ..... 132/200, 132/213, 213.1, 214; 30/30
See application file for complete search history.

(56) References Cited

U.S. PATENT DOCUMENTS 4,471,791 A * 9/1984 DeRoche ..... 132/271

* cited by examiner

*Primary Examiner*—Robyn Doan
(74) *Attorney, Agent, or Firm*—Myron Amer P.C.

(57) ABSTRACT

A method of hairstyling using a comb urged in a pivotal traverse through a patron's hair to position progressively larger-sized strands thereof in an acute angled cutting plane and after cutting removal, the hair strands remaining have a desirable layered appearance along a head-encircling hairline of the hairstyle.

1 Claim, 3 Drawing Sheets

Fig. 1
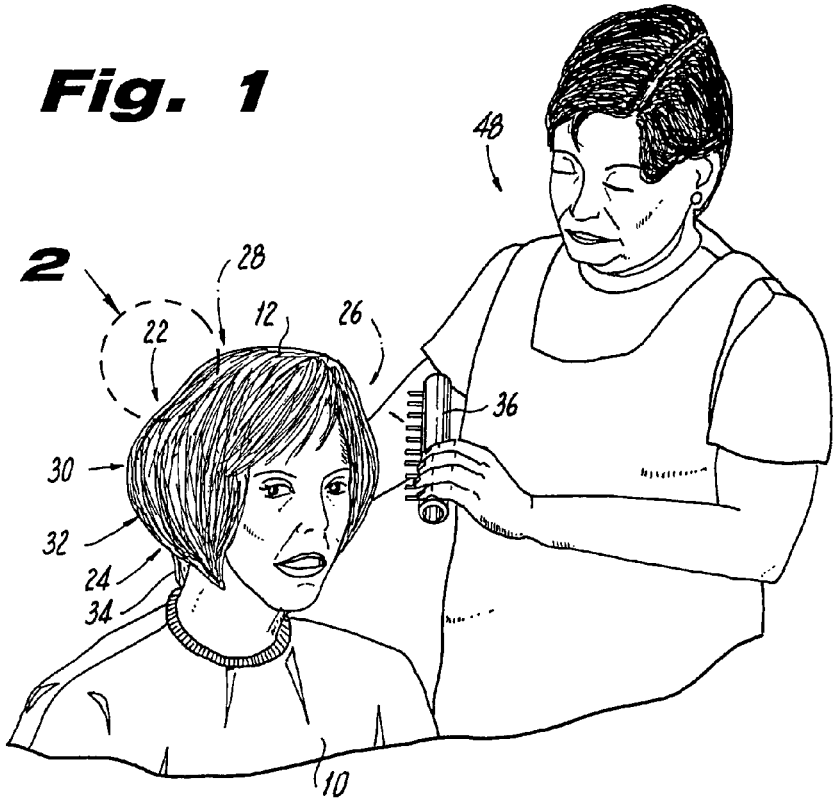
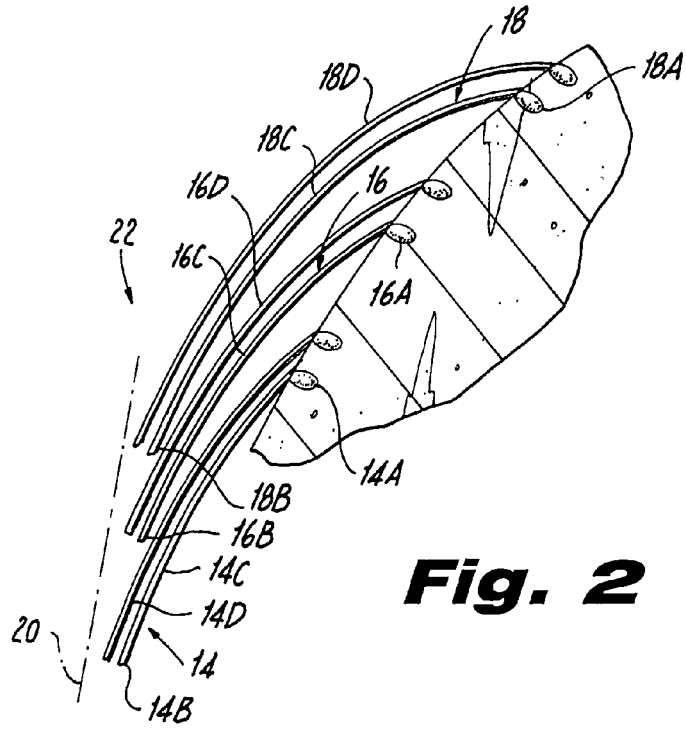
Fig. 2

Fig. 6
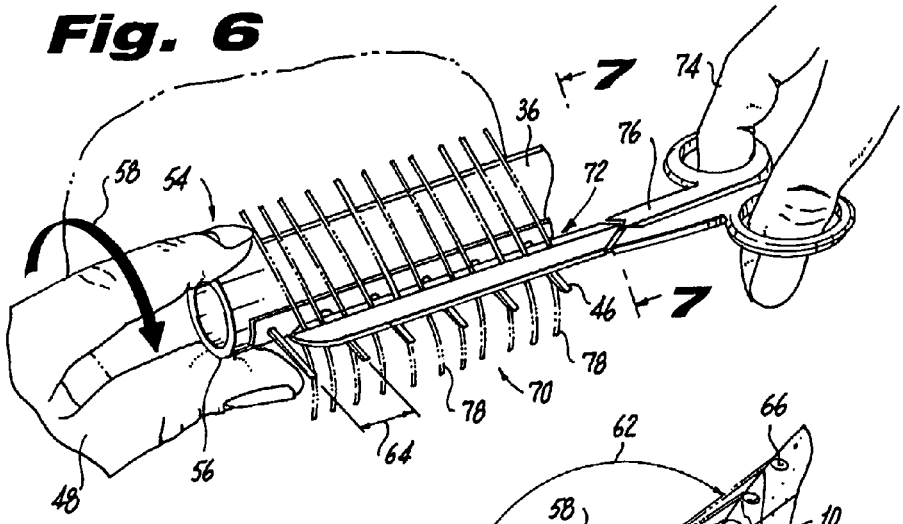
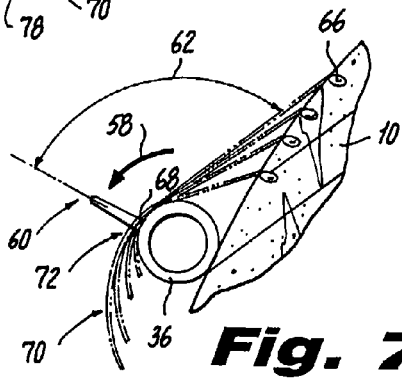
Fig. 7
Fig. 8
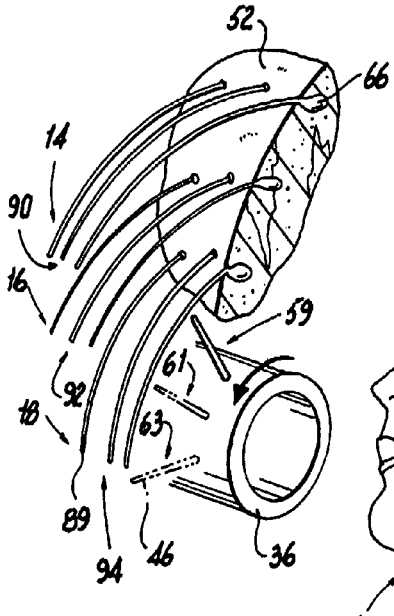
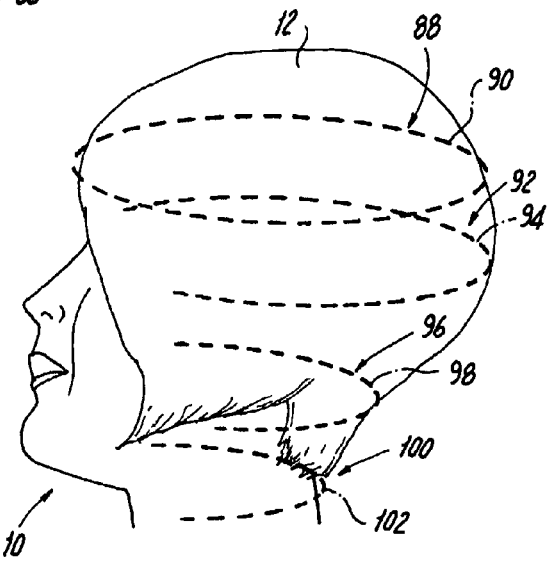
Fig. 9

HAIRSTYLING METHOD

The present invention relates generally to improvements in styling a hair salon patron's hair in which, more particularly, the styling imparts a desirable layered or tapered appearance.

BACKGROUND OF THE INVENTION

1. Field of Search

It is already well known, as exemplified by U.S. Pat. No. 2,225,454 for "Curler" issued to S. F. Kayn on Dec. 17, 1940 and U.S. Pat. No. 2,254,816 for "Hair Curler" issued to M. Bergmann on Sep. 2, 1941, to mention but a few, that imparted styling of hair can be achieved by having strands of the hair wound about and thus made to assume the circular shape of underlying so-called curlers, wherein the hair strands, when the curlers are removed, retain their circular shape as so-called "curls". The styling or appearance provided by the curls is however limited in fulfilling fashion trends, particularly a current trend of a layered or tapered appearance in the free ends of the hair strands, and a hair style having a tapered appearance is thus left to the skill of the stylist in using, as this often is typically the case, only a comb and a scissors, and results in inconsistent patron satisfaction.

SUMMARY OF THE INVENTION

Broadly, it is an object of the present invention to overcome the foregoing and other shortcomings of the prior art.

More particularly, it is an object to enable the hair stylist to shape the hair strands with the comb in duplication of the functioning of curlers, but to better advantage in achieving the desired layered or tapered appearance, all as will be better understood as the description proceeds.

BRIEF DESCRIPTION OF THE DRAWINGS

The description of the invention which follows, together with the accompanying drawings should not be construed as limiting the invention to the example shown and described, because those skilled in the art to which this invention appertains will be able to devise other forms thereof within the ambit of the appended claims.

FIG. 1 is a perspective view of a hair salon patron having her hair styled according to the method of the present invention;

FIG. 2 is a partial sectional view, on an enlarged scale, of details of the tapered appearance in the area circumscribed by the arrow 2 of FIG. 1 of the hair style;

FIG. 6 is a view similar to FIG. 4 but illustrating a subsequent step in the hair styling method;

FIG. 7 is a view similar to FIG. 5 but as seen in the direction of the arrows 7-7 of FIG. 6;

FIG. 8 is a side elevational view illustrating the styling of the hair achieved by the method steps C, E and G; and FIG. 9 is a perspective view illustrating the tapered appearance of the completed hair style.

DETAILED DESCRIPTION OF THE INVENTION

Figure 3:
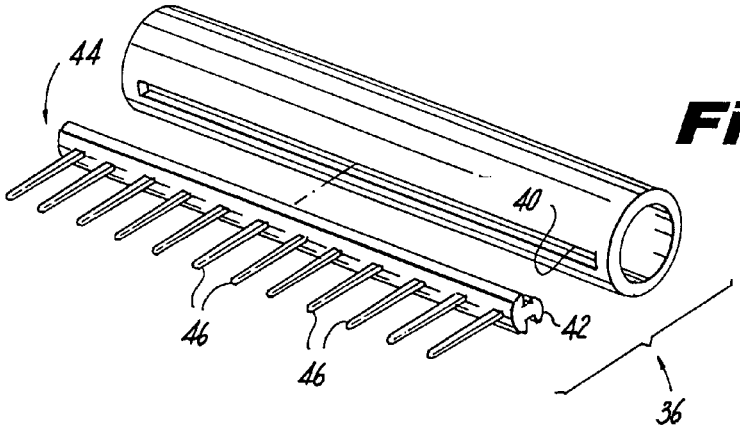
FIG. 3 is an isolated perspective view of a hair-cutting guide component used in the hair styling method.
Figure 4:
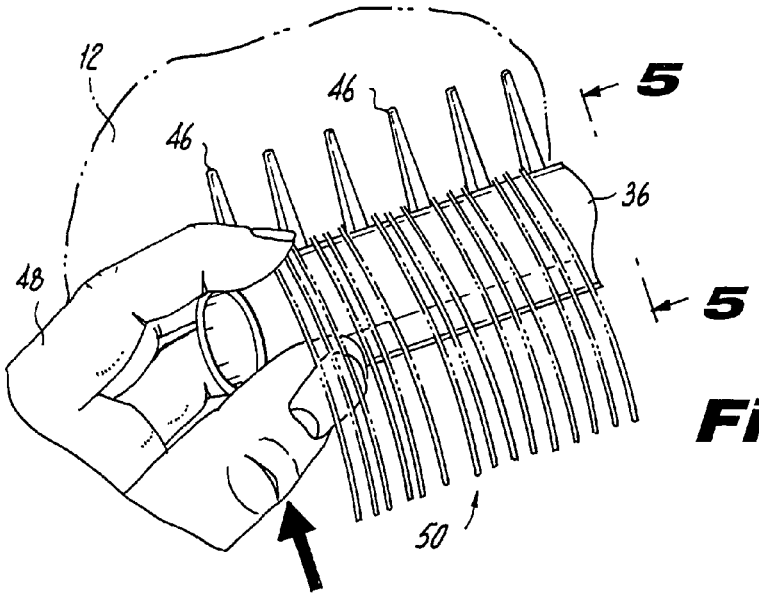
FIG. 4 is a perspective view illustrating a preliminary step in the hair styling method.
Figure 5:
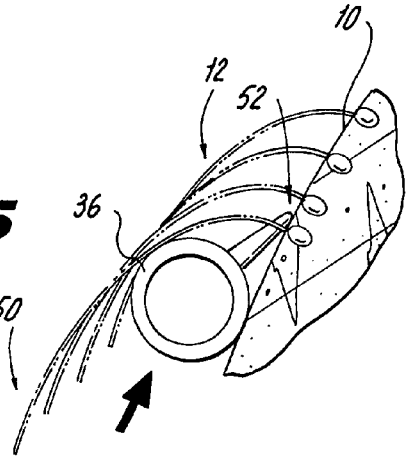
FIG. 5 is a side elevational view as seen in the direction of the arrows 5-5 of FIG. 4.

The invention is a method of styling a hair salon patron's 10 hair 12, the nature or characterizing appearance of the hair style being best understood from the detailed description of singled-out hair strands 14, 16 and 18 which follow.

Each hair strand 14, 16 and 18 respectively extends from scalp follicles 14A, 16A and 18A to free ends 14B, 16B, 18B and measured from follicle to free end each is a selected first length 14C, a slightly greater length 16C and greatest length 18C, so that the three lengths and, more particularly, their overlapping relation provide a tapered appearance along the hair line, as noted by the dash line 20, which results from hair strands 14D adjacent the hair strand 14, hair strands 16D, adjacent the hair strand 16, and hair strands 18D adjacent the hair strand 18, being respectively of the same lengths 14C, 16C and 18C.

The tapered appearance 22 applied to the singled-out hair strands 14, 16 and 18 and hair strands 14D, 16D and 18D adjacent thereto, is shown in FIG. 1 embodied in a side 24 of the patron 10, but is to be understood in practice to be embodied, in a similar fashion as subsequently to be described, to the other side, as noted at 26, and to the rear, as noted at 28, to the full head of hair 12 of the patron, so that the tapered appearances 22, 30 and 32 are contiguous to each other and are perceived as a hair style along a head-encircling lower edge 34 of full head of hair 12 of the patron 10.

To provide successively tapered appearance 22, and then the tapered appearances 30 and 32, use is made of a hair-cutting guide, generally designated 36, having a cylindrical body 38 provided with a slot 40 oriented lengthwise of the body 38. Disposed in a friction fit in slot 40 is a base 42 of a comb 44 having teeth, individually and collectively designated 46, extending from the base 42.

The salon hair stylist 48 places the hair-cutting guide 36 beneath a selected grouping of hair strands as exemplified by the hair strand group 50, with the comb teeth 46 in an initial position against the scalp of the patron 10, a scalp contacting position as noted at 52.

Next, the stylist 48, who has one hand gripped, as at 54, about an end 56 of the hair-cutting guide 36 urges the comb teeth 46 in a pivotal traverse 58 from the starting position 52 into a subsequent position of rotation 60 to an approximately subtended acute angle 62 which draws the hair strands between the clearance 64 between the teeth 46 into taut conditions extended from their scalp follicles 66 to their engagement, as at 68, to the teeth 46. The hair lengths, individually and collectively designated 70, extending beyond the comb teeth 46 constitute a line of demarcation 72 which is presented to the hair stylist 48 and serves as a cutting guide.

With the other hand 74, the stylist removes, by cutting either with a razor or scissors 76, the excess hair strand lengths 78 along the guide line 72.

The consequence of the subtended acute angle 62 provides a taper appearance 80 to the hair strand ends 82 in the angled plane 84 of the cutting stroke of razor or scissors.

The initial positioning and subsequent pivotal traverses 58 are repeated for the first tapered layer 88 along the head-encircling length 90, and then the hair-cutting guide 36 moved downwardly into engagement with the hair strands of what will constitute the second or intermediate tapered layer 92 and the initial positioning and subsequent pivotal traverses 58 repeated along the head-encircling length 94, and in a concluding step the hair-cutting guide is again moved downward into engagement with the hair strands of what will constitute the third or lowermost tapered layer 96 and the initial positioning and subsequent pivotal traverses 58 repeated along the head-encircling length 98.

What has been just described in applying the hair style using the hair-cutting guide 36 along the hair-encircling length 90 is repeated for the hair-encircling lengths 94 and 98 so that a contiguous hair style characterized by a tapered appearance 100 is provided along a head-encircling lower edge 102 of the entire head of hair of the patron 10.

SUMMARY

Summarizing the aforesaid inventive hairstyling method and, as best understood from FIG. 8, using the hair-cutting guide the stylist 48 places the hair-cutting guide 36 beneath hair strands of a selected extent of not less than three groups 14, 16 and 18 which are to be styled in a horizontally oriented condition with the comb teeth 46 extending beneath the three hair strand groups and radially therefrom and in contact with said patron's scalp 52; next the stylist 48 rotates the cylindrical body of the hair-cutting guide 36 from a starting position of movement 59 adjacent a patron's scalp 52 to a first position of movement 61 subtending a first acute angle effective in drawing taut comb teeth-engaged hair strands 14, 16 and 18 of all three groups in extended relation from scalp follicles thereof to said comb teeth; next using as a cutting guide the comb teeth 46 in the rotated position thereof the stylist 48 cuts off only the first group 14 in an external condition of the three groups 14, 16 and 18. Following this step, the stylist 48 rotates the cylindrical body of the hair-cutting guide 36 from the starting position 59 to a next second position of rotation 61 subtending a second acute angle effective in drawing taut the hair strands of the second group 16 in an intermediate condition of the three groups 14, 16 and 18. Next, the stylist 48 cuts off the hair strands of the second group 16 extending outwardly and along the comb teeth 46, and then rotates the cylindrical body of the hair cutting guide 36 from the second position of movement to a third position of movement 63 subtending a third acute angle effective in drawing taut the hair strands of the third group 18 in an inner condition of the three groups 14, 16 and 18. In cutting off the hair strands of the third group 18 extending outwardly and along the comb teeth 46, the cut ends 90, 92 and 94 of the three groups of hair strands 14, 16 and 18 provide a tapered appearance, as noted at 80 which results from the progressively longer lengths of the three groups 14, 16 and 18.

While the cutting guide for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of styling a patron's hair to have a tapered appearance along a head-encircling lower edge thereof comprising the steps of:

A. using a hair-cutting guide having a cylindrical body, a slot oriented lengthwise of said body, and a comb with a base having teeth extending therefrom, said comb base having an operative position disposed in said slot;

B. placing said hair-cutting guide beneath hair strands of a selected extent of not less than three groups which are to be styled in a horizontally oriented condition with said comb teeth extending beneath said three hair strand groups and radially therefrom and in contact with said patron's scalp;

C. rotating said cylindrical body of said hair-cutting guide from a starting position of movement adjacent a patron's scalp to a first position of movement subtending a first acute angle effective in drawing taut comb teeth-engaged hair strands of all said three groups in extended relation from scalp follicles thereof to said comb teeth;

D. using as a cutting guide said comb teeth in said rotated position thereof in cutting off only said first group in an external condition of said three groups;

E. rotating said cylindrical body of said hair-cutting guide from said starting position to a next second position of rotation subtending a second acute angle effective in drawing taut said hair strands of said second group in an intermediate condition of said three groups;

F. cutting off said hair strands of said second group extending outwardly and along said comb teeth;

G. rotating said cylindrical body of said hair cutting guide from said second position of movement to a third position of movement subtending a third acute angle effective in drawing taut said hair strands of said third group in an inner condition of said three groups; and H. cutting off said hair strands of said third group extending outwardly and along said comb teeth;

whereby said cut ends of said three groups of hair strands provide a tapered appearance as results from the progressively longer lengths thereof.

* * * * *